US005531455A

United States Patent [19]

Calixto

[11] Patent Number: 5,531,455

[45] Date of Patent: Jul. 2, 1996

[54] EXPANSION JOINT SEALING ELEMENT

[76] Inventor: Jorge Gabrielli Z. Calixto, Rua Gregorio Paes de Almeida, 960-Vila Madalena-CEP, 05450-001 Sao Paulo -SP, Brazil

[21] Appl. No.: 149,241

[22] Filed: Sep. 16, 1993

[51] Int. Cl.[6] ..... F16J 15/46

[52] U.S. Cl. ..... 277/34; 277/201; 277/209; 52/396.06; 52/396.07; 49/477.1; 49/489.1

[58] Field of Search ..... 277/34, 34.3, 34.6, 277/167.5, 201, 202, 208, 209, 210; 52/396.03, 396.04, 396.06, 396.07, 396.08; 49/477.1, 489.1, 495.1

[56] References Cited

U.S. PATENT DOCUMENTS

| | | | |
|---|---|---|---|
| 2,016,968 | 10/1935 | Marble | 52/396.04 X |
| 3,074,520 | 1/1963 | Grubelich | 49/477.1 |
| 3,213,584 | 10/1965 | Bush | 49/489.1 |
| 3,378,958 | 4/1969 | Parks et al. | 49/489.1 |
| 3,501,868 | 3/1970 | Ganzinotti | 277/34.3 X |
| 3,508,369 | 4/1970 | Tennison | 52/396.08 |
| 3,763,595 | 10/1973 | Sudyk | 49/489.1 |
| 3,899,260 | 8/1975 | Kerschner | 52/396.06 X |
| 3,923,411 | 12/1975 | Berghman | 52/396.06 X |
| 4,807,397 | 2/1989 | Doan | 49/489.1 |
| 4,884,381 | 12/1989 | Betti . | |
| 5,248,542 | 9/1993 | Hitzpeter et al. | 49/489.1 |

FOREIGN PATENT DOCUMENTS

| | | | |
|---|---|---|---|
| 504675 | 9/1992 | European Pat. Off. | 277/208 |
| 1342662 | 9/1963 | France | 49/489.1 |
| 1345975 | 12/1963 | France | 277/209 |
| 1262550 | 3/1968 | Germany | 52/396.07 |
| 2006082 | 8/1971 | Germany | 52/396.07 |
| 1093743 | 12/1967 | United Kingdom | 49/489.1 |

*Primary Examiner*—Scott W. Cummings
*Attorney, Agent, or Firm*—Ruffin B. Cordell; Michael J. McKeon

[57] ABSTRACT

An expansion joint sealing element, consisting of an arrow-shaped elastomer strip (1), defined by a triangular head (2) and a rear insertion section (3) with an angled end (4), while its lateral walls (5) are externally corrugated (6), an arrangement that is repeated on the external surface of the base (7) and on the lateral sections of the head (2), which, along with the insertion section (3), have various internal, longitudinal hollow sections defined by various interior walls (8), forming an insufflation chamber (9), so that one end of the strip (1) is closed off, while the other is fitted with a cover (10) and a valve (11), the latter being used to inject air so that the walls of the elastomer strip press against the adhesive applied to its lateral walls, where ridges considerably increase the area of adhesion and prevent the strip from moving while said adhesive cures.

7 Claims, 3 Drawing Sheets

EXPANSION JOINT SEALING ELEMENT

BACKGROUND OF THE INVENTION

The present invention relates to an improved expansion joint sealing element or, more specifically, to specially developed technical and functional improvements taking into account the characteristics of an ideal expansion joint sealing element, suitable for use in different situations, primarily when significant movements and considerable hydraulic pressure are involved, as is generally the case in dams.

As those familiar with this technology already know, the importance of the sealing element in the expansion joints used in public works construction has been widely recognized for many years. It becomes even more important as the stress on it increases, especially when subjected to significant movements and hydraulic pressure, as is generally the case in dams.

At present, three different types of sealing elements are regularly used in dams: strips of copper, strips of PVC and mastics between elastomer sheets. Although the above noted sealing elements can be used in expansion joints, they are subject to certain limitations or disadvantages, such as: A) strips of PVC, positioned during the laying of the concrete and affixed to the frame, are not elastic and, consequently, do not retain their shape and position when subjected to deformations; B) mastic protected by elastomer sheets, when subjected to high pressure, leak out if a seam breaks; and C) the sheets are generally affixed by means of metal angle plates and anchor bolts, which can rust.

Given the above circumstances and disadvantages and with a view to overcoming them, the present invention was created, which consists essentially of a non-metal sealing element affixed by means of a strong polymer adhesive and made of a high quality elastomer, especially as regards its resistance to weather, alkalis, molds, mildew, oil, grease, etc.

OBJECTS AND BRIEF SUMMARY OF THE INVENTION

An advantageous factor of the present invention is the cross section of the device since, unlike conventional joint sealing element, it is in the form of an elastomer strip with a unique arrow shape, which is hollow or which has hollow sections that form longitudinal chambers. The novel external configuration of the expansion joint sealing element consists of a triangular head and a rear section that can be inserted into a joint wherein the joint is entirely covered by the element head. The rear section of the element is preferably provided with ridges or uneven surfaces (viz. corrugations) that adapt to the inner walls of the joint and to the exterior walls that are adjacent to the joint.

Yet another advantage of the expansion joint sealing element of the present invention is the fact that the size of the extruded elastomer strip is perfectly suited to the expansion joint and the stresses on it, as well as the fact that it can be inserted in the expansion joint to be sealed either all at once or in consecutive stages.

Still another advantage of the expansion joint sealing element of the present invention is the existence of a valve, previously installed in the strip, the ends of which are closed, thereby permitting the injection of air into internal chambers of the strip. The presence of the corrugations considerably increase the area of adhesion such that when the air is injected, the walls of the elastomer strip, with exposed corrugations, press against the adhesive and prevent the strip from moving while the adhesive cures.

Still another advantage of the expansion joint sealing element of the present invention is the novel edge configuration of the strip, which form the base of the triangular head of the strip, whereby the edges are affixed to the concrete with a device that exerts mechanical pressure on it.

DRAWINGS

Other objects and advantages of the present invention will become apparent from the following detailed description of a preferred embodiment thereof taken in conjunction with the accompanying drawings, wherein.

DETAILED DESCRIPTION

Figure 1:
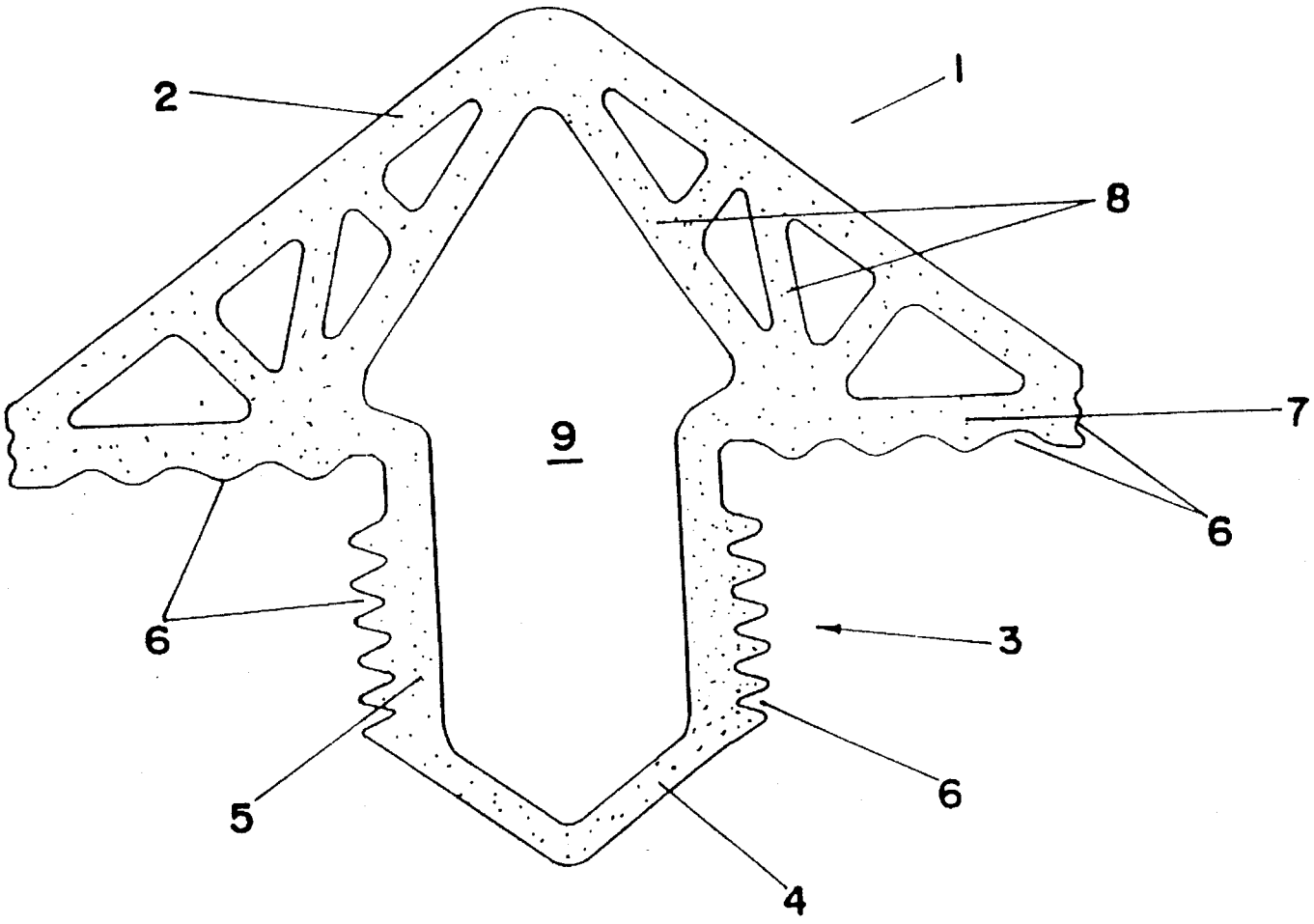
FIG. 1 is a cross-section, illustrating the shape of the elastomer strip.
Figure 2:
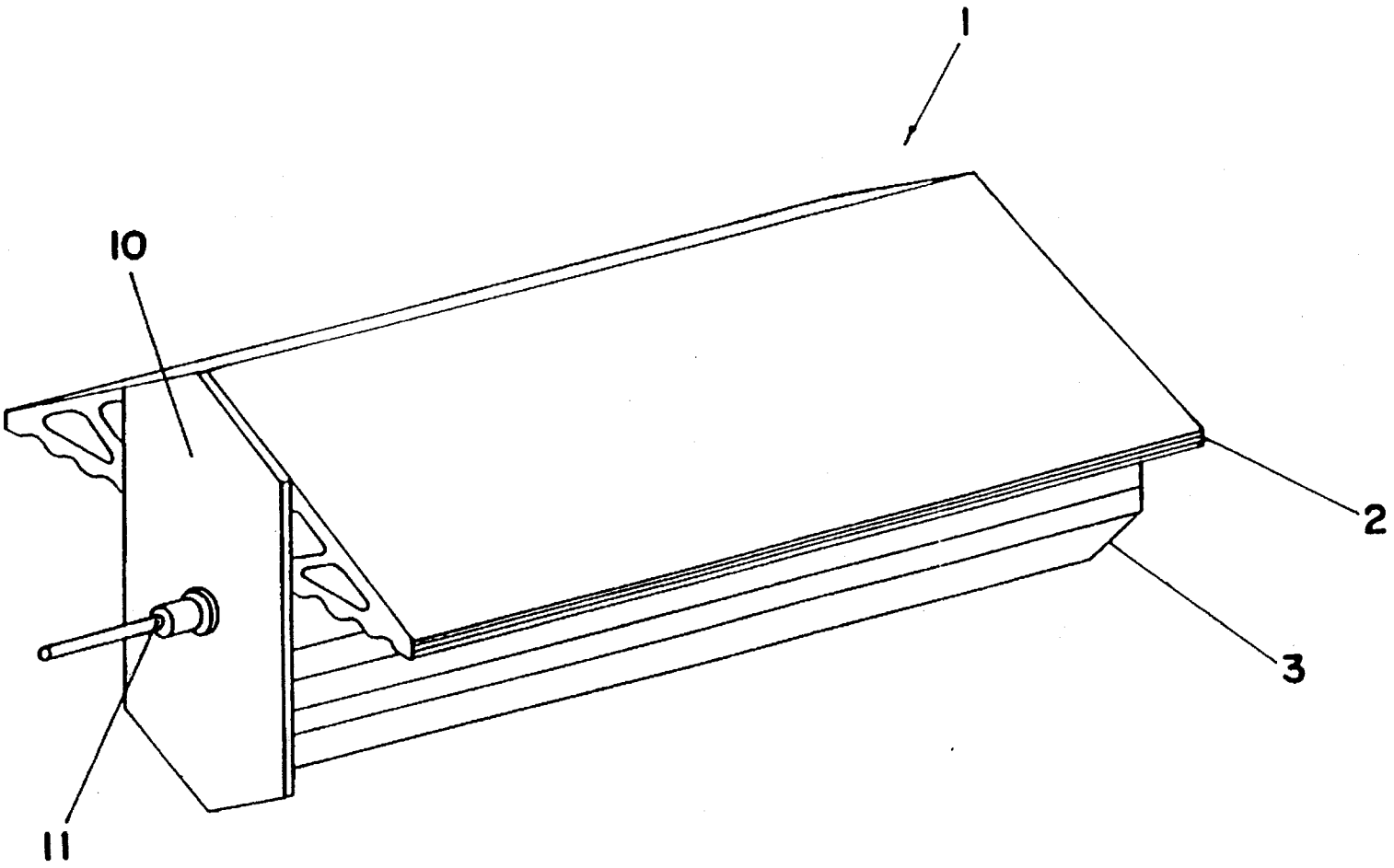
FIG. 2 is a perspective view showing the end of the strip with a valve.

Referring now to the drawings and particularly to FIG. 1, an embodiment of the improved expansion sealing joint element is shown which includes an arrow-shaped elastomer strip (1) consisting of a triangular head (2) and a rear insertion section (3). The rear insertion section (3) occupies about a third of the cross-sectional width of the base (7) of the head (2) and the distal end (4) of the rear wall appears comprises two adjacent panels that form a wide angle like the two sides of a roof. Lateral walls (5) are externally corrugated or ridged (6), an arrangement that is also found on the external surface of the base (7) and the lateral sections of the head (2). The head (2), along with the insertion section (3), has various longitudinal hollow sections defined by various interior walls (8) which are positioned at different angles to one another and to the lateral walls of the strip, thus forming an actual chamber (9), also in the shape of an arrow, for inflation. One end of the strip (1) is closed off or appropriately sealed, while the other end is fitted with a cover (10) and a valve (11) (note FIG. 2).

Figure 3:
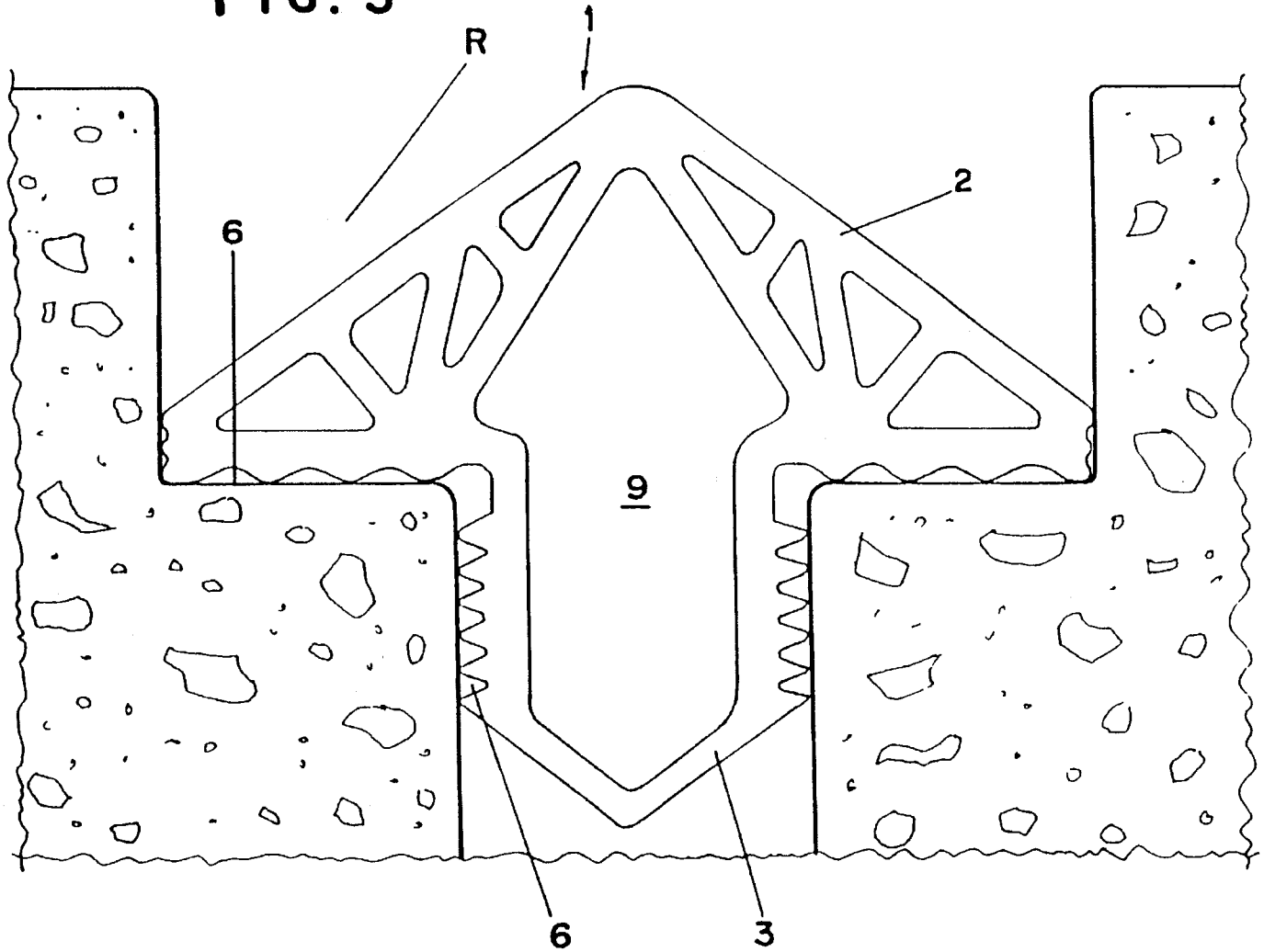
FIG. 3 is a cross-section of the sealing element inserted in a joint.

With this arrangement, the strip (1) of the present invention may be inserted and positioned within a given joint, as illustrated in FIG. 3. Once positioned, air is pumped into the interior chamber of the strip (1), so that the walls of the elastomer strip press against the adhesive applied to the sides of the strip. The ridges (6) serve to considerably increase the area of adhesion and prevent the strip from moving while said adhesive cures.

A recess (R) in the concrete is provided in plan so that the strip remains confined within this space, and when hydraulic pressure is exerted, the strip (1) will encounter lateral resistance and will be deflected against its interior walls, thus preventing tractive stress on the concrete. It is well known that concrete has little tensile strength and is approximately 10 (ten) times more resistant to compression.

When hydraulic pressure is exerted, the strip is deformed and presses against the edges of the concrete, distributing the compressive forces and providing a better performance of the system. Moreover, the strip absorbs structural movements caused by traction, compression, shearing, uneven settling and rotation.

The instant expansion joint sealing element is an improvement over prior art arrangements and provides an increase in efficiency, an improvement in operational performance and is easier to use in application. In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

I claim:

1. An expansion joint sealing element comprising:

an elongate elastomer strip having a longitudinal head portion and a longitudinal insertion portion operably connected to said longitudinal head portion such that said elongate elastomer strip is configured in cross-section to have a generally arrow shape with a first and second cross-sectional end;

said longitudinal head portion defined in cross-section by opposed panels that slope from said first cross-sectional end toward said second cross-sectional end, further comprising a base portion such that said adjacent panels of said longitudinal head portion and said base portion interact to form a generally triangular shaped head, said adjacent panels further configured to define a portion of a central internal strip chamber; and said longitudinal insertion portion defined in cross-section by opposed lateral walls extending from said base portion of said longitudinal head portion and terminating in a rear wall at said second cross-sectional end, said rear wall defined by adjacent panels sloping from said second cross-sectional end toward said first cross-sectional end such that said adjacent panels of said longitudinal insertion portion and said opposed lateral walls further define said central internal strip chamber; and a plurality of ridges formed on outer surfaces of said opposed lateral walls of said longitudinal insertion portion and on an outer surface of said base of said longitudinal head portion.

2. An expansion joint sealing element as defined in claim 1 wherein said central internal strip chamber is configured in cross-section to have a generally arrow shape corresponding to said generally arrow shape of the elastomer strip.

3. An expansion joint sealing element as defined in claim 1 further comprising:

a plurality of longitudinal chambers formed within said longitudinal head portion and positioned on opposing sides of said central internal strip chamber.

4. An expansion joint sealing element as defined in claim 3 wherein said plurality of longitudinal chambers are defined by corresponding interior walls such that each of said walls is positioned at a different angle with respect to any other of said interior walls and with respect to said opposed lateral walls of said longitudinal insertion portion.

5. An expansion joint sealing element as defined in claim 1 further comprising:

a strip cover secured to one end of said elastomer strip and a valve operable with said cover to seal said central internal strip chamber at said one end of said elastomer strip; and a means for sealing the other end of said central internal strip chamber;

wherein said valve may be utilized to inflate said central internal strip chamber with air.

6. An expansion joint sealing element as defined in claim 1 wherein said base of said longitudinal head portion comprises in cross-section a left base component positioned on the left side of said central internal chamber and a right base component positioned on the right side of said central internal chamber, each having a width.

7. An expansion joint sealing element as defined in claim 6 wherein said longitudinal insertion portion has a cross-sectional width substantially equal to the cross-sectional width of the left and right base portions.

* * * * *